US005255861A

United States Patent [19]

Lerner

[11] Patent Number: 5,255,861

[45] Date of Patent: Oct. 26, 1993

[54] TOILET PAPER HOLDER ASSEMBLY WITH AUXILIARY TISSUE ROLL

[76] Inventor: Saul Lerner, 3650 N. 36th Ave. #62, Hollywood, Fla. 33021

[21] Appl. No.: 888,185

[22] Filed: May 26, 1992

[51] Int. Cl.[5] ..... B65H 16/00; B65H 18/00

[52] U.S. Cl. ..... 242/55.2; 242/1

[58] Field of Search ..... 242/55.2, 55.3, 1; 206/390, 820

[56] References Cited

U.S. PATENT DOCUMENTS

| | | | |
|---|---|---|---|
| 649,062 | 5/1900 | Levett | 242/55.55 |
| 1,012,543 | 12/1911 | Hallett | 242/55.53 |
| 1,963,233 | 12/1932 | Goldstein | 206/47 |
| 2,073,719 | 3/1937 | Ross | 242/55.2 |
| 2,224,470 | 12/1940 | Boust | 242/55.2 |
| 2,518,328 | 9/1948 | Janonis | 242/55.2 |
| 2,555,205 | 5/1951 | Steffens | 242/55.3 X |
| 2,694,533 | 3/1954 | Zucker | 242/55.4 |
| 2,752,106 | 6/1956 | Thompson | 242/55.2 |
| 2,801,809 | 8/1959 | Glaner | 242/55.3 |
| 2,988,283 | 6/1961 | Garfield | 239/52 |
| 3,002,704 | 10/1961 | Grossfeld | 242/55.55 |
| 3,145,940 | 8/1964 | Henry | 242/55.2 |
| 4,034,926 | 7/1977 | Wegner | 242/55.53 |
| 4,113,195 | 9/1978 | Theunissen | 242/55.3 |
| 4,860,893 | 8/1989 | Kaufman | 206/390 |
| 4,989,801 | 2/1991 | Thomas et al. | 242/55.53 |

*Primary Examiner*—John M. Jillions
*Assistant Examiner*—Eileen Dunn
*Attorney, Agent, or Firm*—Herbert L. Lerner; Laurence A. Greenberg

[57] ABSTRACT

A toilet paper holder assembly comprises a spindle to be attached to a bathroom fixture for rotatably supporting a roll of toilet paper surrounding the spindle, and an auxiliary toilet paper roll which snugly fits in between the spindle and the inner core of the main toilet paper roll. The auxiliary roll provides an extra supply of toilet paper and aids in firmly supporting the toilet paper roll on the spindle.

5 Claims, 1 Drawing Sheet

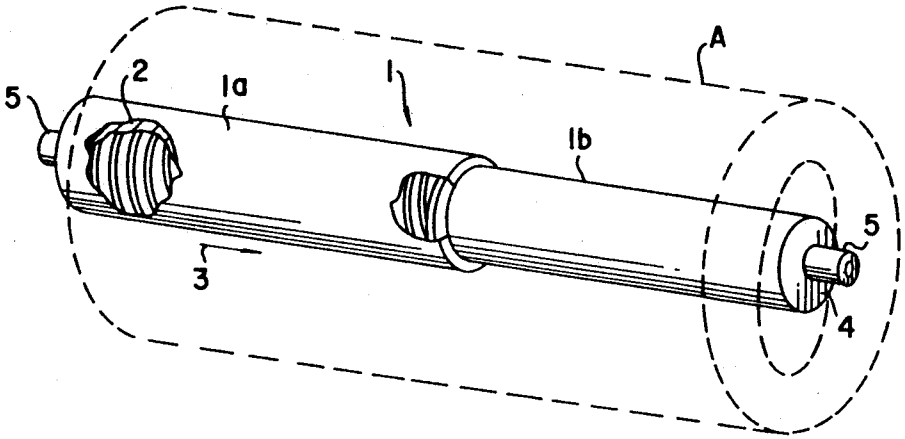
FIG.1
PRIOR ART
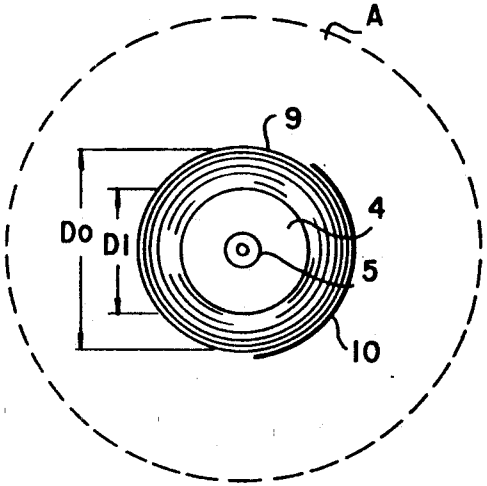
FIG.4
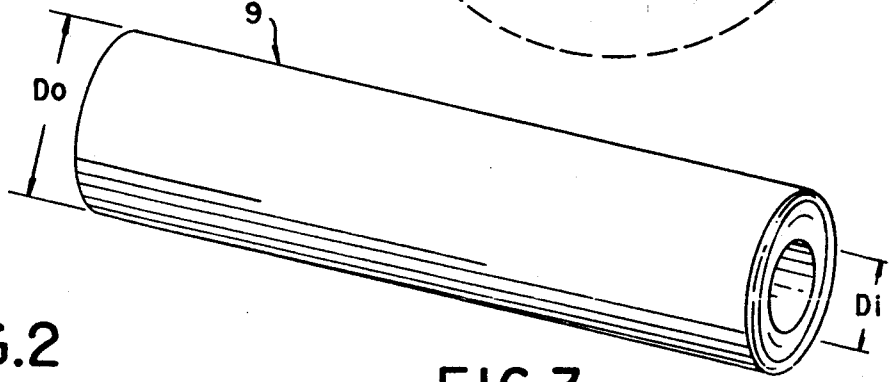
FIG.3
FIG.2
PRIOR ART
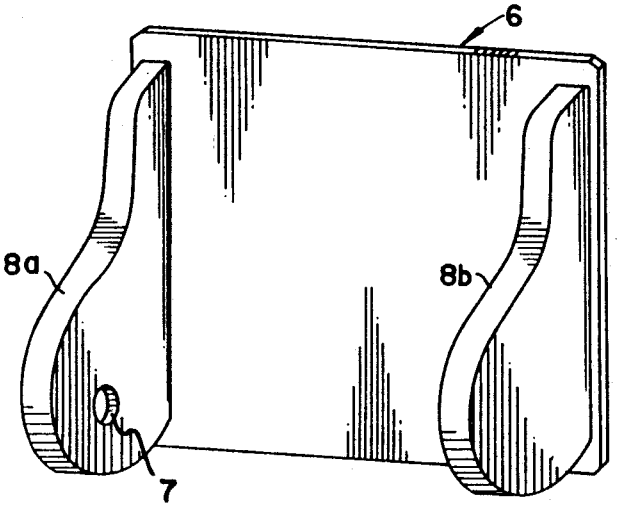

TOILET PAPER HOLDER ASSEMBLY WITH AUXILIARY TISSUE ROLL

BACKGROUND OF THE INVENTION

1. Field of the Invention

The invention relates to an emergency supply of toilet paper and, more particularly, to an auxiliary roll of toilet paper in the form of a sleeve for a standard spring-loaded spindle of a toilet paper holder to be disposed between the spindle and the inner core of the main tissue roll.

2. Description of the Prior Art

In household situations, but especially in public toilets and toilets in industrial and commercial establishments, where many people use the same facilities, not everyone is considerate enough to replace an empty roll of toilet paper. Therefore, people may be inconvenienced by finding that such a roll is empty and no replacement roll is conveniently available.

It is paramount to have access to an additional amount of toilet tissue, should the person require more paper than is left on the original roll. Such a situation is particularly disturbing in an environment with persons who require special attention, such as in nursing homes.

The foregoing problems have been addressed in the prior art, for instance in U.S. Pat. No. 2,801,809 to Glaner and my published international application PCT/US91/04507 (published as WO 91/19663). In those disclosures, an emergency supply of toilet tissue is disposed inside the empty compartment of the toilet paper holder spindle. One of the disadvantages associated with these devices is the fact that the auxiliary supply of tissue is not readily found by an unknowing user since the tissue is practically hidden inside the spindle. Also, a specially constructed spindle is required for those devices.

A further problem in this context is addressed in U.S. Pat. No. 3,145,940 to Henry. The patent entitled "Silent Toilet Tissue Roll" deals with the object of eliminating noises during the unrolling of tissue. The "clattering and bumping noises" which, in many situations, may be quite embarrassing, are partly silenced by placing annular cushion elements between the spindle and the cardboard core of the toilet paper holder. Again, the device requires structural changes in the toilet paper holder assembly.

It is accordingly an object of the invention to provide a toilet paper holder, which overcomes the hereinaforementioned disadvantages of the heretofore-known devices of this general type and which allows the storage of a certain amount of emergency toilet paper without requiring any modifications in the conventional support assembly, and which acts as a "silencer" and "shock absorber" during the unrolling of tissue from the paper roll. It is ensured with the instant invention that, once the supply of tissue on the roll of toilet paper has been depleted, there is a sufficient amount of paper available on an auxiliary roll.

SUMMARY OF THE INVENTION

With the foregoing and other objects in view there is provided, in accordance with the invention, a toilet paper holder assembly having an elongated cylindrical spindle to be attached to a toilet paper fixture for supporting a roll of toilet paper surrounding the spindle, the spindle having a given greatest outer spindle diameter and the roll of toilet paper having a core with an inner core diameter greater than the given outer spindle diameter, in which the improvement comprises an auxiliary roll of toilet paper having an inner roll diameter and an outer roll diameter, the inner roll diameter being greater than the given greatest outer spindle diameter, and the outer roll diameter being smaller than the inner core diameter of the roll of toilet paper.

In accordance with a concomitant feature of the invention, a layer of, preferably shrink-wrapped, plastic is formed on the outside of the auxiliary roll.

Accordingly, if the user of the bathroom happens to find him or herself in a sitation as described above, the person simply removes the empty cardboard core of the main roll, optionally also takes the spring-loaded spindle out, and removes the extra supply from the auxiliary roll or inner sleeve.

It is evident that such backup rolls can be sold in supermarkets, pharmacies, convenience stores, etc., packed for instance, in packages of 5 or 10 or may even be given away as novelty items. Toilet tissue companies and stores enjoy added sales and provide customers a sense of relief from the danger of encountering the inconvenience and embarrassment of running out of toilet paper.

Other features which are considered as characteristic for the invention are set forth in the appended claims.

Although the invention is illustrated and described herein as embodied in a toilet paper holder assembly with auxiliary tissue roll, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 1 is a perspective, partly broken-away view of a prior art spring-loaded toilet paper holder spindle;

FIG. 2 is a perspective view of a prior art bathroom fixture for holding the toilet paper holder of FIG. 1;

FIG. 3 is a perspective view of the auxiliary tissue roll according to the invention; and FIG. 4 is a side-elevational view of a spindle of FIG. 1, surrounded by the auxiliary roll according to the invention which, in turn, is surrounded by the main toilet paper roll, indicated in dashed lines.

DESCRIPTION OF THE PREFERRED EMBODIMENTS

Referring now to the figures of the drawing in detail and first, particularly, to FIG. 1 thereof, there is seen a cylindrical toilet paper holder spindle, or tube 1. The tube 1 has two halves or cylindrical portions 1*a* and 1*b*. The outer diameter of the portion 1*b* is slightly smaller than the inner diameter of the portion 1*a*. The portion 1*b* is partially inserted into the portion 1*a*.

A spring 2 is disposed within the portion 1*a*, as shown in the broken-away section of FIG. 1. The spring 2, which abuts against the non-illustrated end of the portion 1*b* which is inserted in the portion 1*a*, exerts a force on the portion 1*b* in the direction of an arrow 3 and thus biases end faces 4 of the spindle 1 in opposite directions. A non-illustrated stopping mechanism prevents the portion 1b from being pushed out of the portion 1a by the force of the spring 2.

A nipple 5, the center axis of which is coincidental with the longitudinal axis of the toilet paper holder 1, is disposed on the end face 4. A further nipple 5 is disposed on the distal end of the portion 1a.

An auxiliary or emergency roll 9 according to the invention has an inner core diameter $D_i$ which corresponds to the outer diameter of the spindle 1, in particular to that of the spindle portion 1a. An outer diameter $D_o$ of the auxiliary roll 9 logically corresponds to an inner core diameter of the main toilet tissue roll. The length of the auxiliary roll 9 corresponds to that of the conventional main roll A, in that it is formed with identical tissue. The roll 9, alternatively, may be rolled with narrower paper.

For apparent sanitary reasons, the auxiliary tissue roll 9 may be shrink-sealed or shrink-wrapped with a layer of plastic 10, for instance. This provides the added advantage that the main toilet paper roll A slips onto the auxiliary tissue roll 9 more easily. In most instances, the auxiliary roll 9 will remain unpacked when the main roll A is exchanged. With the shrink-wrapping in place, the auxiliary roll 9 may be retained on the spindle 1 for a virtually unlimited amount of time, i.e. until it is first needed. In such a case of emergency, the wrapper is easily removed from the auxiliary roll 9, and an additional supply of tissue is then available.

As indicated in phatom in FIG. 1, a main toilet tissue roll A has an inner core diameter which is substantially greater than the outer diameter of the spindle 1, thus leaving a certain amount of space therebetween. Customarily, the main tissue is rolled onto a cardboard core and most major manufacturers abide to a core diameter of about 1.5 inches. Most prior art spindles have a greatest outer diameter of approximately $\frac{7}{8}$ inches so that the paper on the emergency supply roll 9 would have an approximate thickness of 5/16 inches. These measurements, naturally, are meant as pertaining to a preferred embodiment and do not limit the protective scope of the appended claims in any way.

After the emergency paper roll 9 is slipped over the spindle, the main tissue roll is, in turn, slipped over the roll 9, and this assembly is then attached to a standard bathroom fixture 6, as shown in FIG. 2.

The length of the fully extended toilet paper holder 1, is slightly greater than the width of the standard bathroom fixture 6, i.e. the distance from a sidewall 8a to a sidewall 8b.

The toilet paper holder spindle 1 is engaged in the bathroom fixture by temporarily compressing the spindle 1 against the force of the spring 2. Then the nipples 5 are aligned with the respective recesses 7. When the spindle 1 is released, the spring 2 extends the spindle 1 to its maximum length allowed by the distance between the walls 8a and 8b. The nipples 5 thereby engage in the recesses 7.

Naturally, many possibilities exist for mounting the spindles 1 on a fixture. Virtually all of the prior art mountings may be used with the spindle 1 of the invention.

I claim:

1. In a toilet paper holder assembly having an elongated cylindrical spindle to be attached to a toilet paper fixture for supporting a roll of toilet paper surrounding the spindle, the spindle having a given greatest outer spindle diameter and the roll of toilet paper having a core with an inner core diameter greater than the given outer spindle diameter, the improvement which comprises: a cylindrical auxiliary roll of toilet paper to be supported in its cylindrical condition on said spindle and inside the core of the roll of toilet paper, said auxiliary roll including a cylindrical core and a substantially continuous web of toilet paper continuously wound around said cylindrical core, said cylindrical core having an inner diameter defining an inner roll diameter and an outer layer of said continuously wound web defining an outer roll diameter, said inner roll diameter being greater than the given greatest outer spindle diameter, and said outer roll diameter being smaller than the inner core diameter of the roll of toilet paper.

2. The assembly according to claim 1, including a layer of shrink-wrapped plastic surrounding said auxiliary roll.

3. In a toilet paper holder assembly wherein a substantially cylindrical elongate body to be attached to a toilet paper fixture rotatably supports a roll of toilet paper surrounding the body and wherein the cylindrical body has an outer body diameter and the roll of toilet paper has a core with an inner core diameter greater than the outer body diameter defining a cylindrical space therebetween, the improvement comprising: a cylindrical auxiliary roll of toilet paper to be disposed in its cylindrical condition in said cylindrical space between said body and said roll of toilet paper, said auxiliary roll including a substantially continuous web of toilet paper continuously wound around an auxiliary paper core having an inner diameter substantially corresponding to the outer body diameter for allowing insertion of the body into said auxiliary roll, and said auxiliary roll having an outer diameter smaller than the inner core diameter for allowing insertion of said auxiliary roll into the roll of toilet paper.

4. The assembly according to claim 3, including a layer of shrink-wrapped plastic surrounding said auxiliary roll.

5. A toilet paper assembly, comprising a substantially cylindrical outer core having a core diameter, a substantially continuous web of toilet paper coaxially wound onto said outer core, a substantially cylindrical inner core to be rotatably supported in its cylindrical condition on a spindle of a toilet paper fixture, said inner core having an axis, a substantially continuous web of auxiliary toilet paper coaxially wound about said axis onto said inner core, said inner core and said auxiliary toilet paper defining an auxiliary roll with an inner diameter approximately corresponding to an outer diameter of the spindle of the toilet paper fixture and an outer diameter approximately corresponding to said core diameter of said outer core for allowing axial insertion of said auxiliary roll in a cylindrical space defined between the spindle of the toilet paper fixture and said outer core.

* * * * *